US009470119B2

(12) United States Patent
Shum et al.

(10) Patent No.: US 9,470,119 B2
(45) Date of Patent: Oct. 18, 2016

(54) CAMSHAFT PHASER

(71) Applicant: DELPHI TECHNOLOGIES, INC., Troy, MI (US)

(72) Inventors: Cai P. Shum, Mendon, NY (US); Jeremy N. Graves, Henrietta, NY (US); Oscar A. Estratti, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 90 days.

(21) Appl. No.: 14/609,545

(22) Filed: Jan. 30, 2015

(65) Prior Publication Data

US 2015/0218975 A1 Aug. 6, 2015

Related U.S. Application Data

(60) Provisional application No. 61/935,952, filed on Feb. 5, 2014.

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01)

(58) Field of Classification Search
CPC ..... F01L 1/344; F01L 1/3442
USPC ..... 123/90.15, 90.17; 464/160
See application file for complete search history.

(56) References Cited

U.S. PATENT DOCUMENTS

| | | | | |
|---|---|---|---|---|
| 7,363,897 | B2 | 4/2008 | Fischer et al. | |
| 8,056,519 | B2 | 11/2011 | Cuatt et al. | |
| 8,127,728 | B2 | 3/2012 | Fischer et al. | |
| 8,881,702 | B1 * | 11/2014 | Lichti | F01L 1/3442 123/90.15 |
| 2010/0288215 | A1 | 11/2010 | Takemura et al. | |
| 2012/0255509 | A1 | 10/2012 | Lichti et al. | |

* cited by examiner

*Primary Examiner* — Ching Chang
(74) *Attorney, Agent, or Firm* — Joshua M. Haines

(57) ABSTRACT

A camshaft phaser is provided for varying the phase relationship between a crankshaft and a camshaft in an engine. The camshaft phaser includes a stator having lobes. A rotor disposed within the stator and rotatable between a full retard position to a full retard position includes vanes extending radially outward from a central hub and interspersed with the stator lobes to define alternating advance and retard chambers. A first portion of the central hub between adjacent vanes extends radially outward further than a second portion of the central hub between adjacent vanes.

18 Claims, 3 Drawing Sheets

CAMSHAFT PHASER

CROSS-REFERENCE TO RELATED PATENT APPLICATIONS

This patent application claims the benefit of U.S. provisional patent application Ser. No. 61/935,952 filed on Feb. 5, 2014, the disclosure of which is hereby incorporated by reference in its entirety.

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser; even more particularly to a vane-type camshaft phaser which includes a bias spring for biasing a rotor relative to a stator; and still even more particularly to a vane-type camshaft phaser where a hub of a rotor is asymmetrical in order to accommodate an arrangement for neutralizing the bias spring for a portion of the rotor travel.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers in order to rotate the rotor within the stator and thereby change the phase relationship between an engine camshaft and an engine crankshaft. Camshaft phasers also commonly include an intermediate lock pin which selectively prevents relative rotation between the rotor and the stator at an angular position that is intermediate of a full advance and a full retard position. The intermediate lock pin is engaged and disengaged by venting oil from the intermediate lock pin and supplying pressurized oil to the intermediate lock pin respectively.

Some camshaft phasers utilize a bias spring to apply a torque to the rotor in order to urge the rotor to rotate, typically in the advance direction of rotation, to either partially or completely offset the natural retarding torque induced by the overall valve train friction to balance performance times, or to help return the phaser to a default position. The bias spring typically applies a torque to the rotor for the entire range of motion of the rotor 18 within the stator, i.e. between the full retard position and the full advance position, and in the direction toward the full advance position. However, the torque of the bias spring applied to the rotor may make engagement of the intermediate lock pin difficult.

U.S. Pat. No. 7,363,897 to Fischer et al. (Fisher '897) teaches an arrangement to aid in engaging the intermediate lock pin. In this arrangement, the bias spring urges the rotor toward the predetermined aligned position from any position retarded of the predetermined aligned position but does not engage the rotor from any position advanced of the predetermined aligned position. While this arrangement may be effective, the arrangement may increase the axial length of the camshaft phaser which may be undesirable in applications where space for the camshaft phaser is limited.

U.S. Pat. No. 8,127,728 to Fisher et al. (Fisher '728) teaches another arrangement to aid in engaging the intermediate lock pin. In this arrangement, a first bias spring urges the rotor toward the predetermined aligned position from any position retarded of the predetermined aligned position and a second bias spring urges the rotor in the advance direction over the full range of rotation of the rotor. Just as with Fisher '897, the arrangement of Fisher '728 may be effective, but the arrangement may increase the axial length of the camshaft phaser which may be undesirable in applications where space for the camshaft phaser is limited.

In another arrangement, a pin may be fixed to a front cover of the camshaft phaser and extend axially toward a back cover of the camshaft phaser. The pin neutralizes the bias spring for a portion of the rotation of the rotor relative to the stator by engaging one end of the bias spring and preventing the bias spring from applying a torque to the rotor for a portion of rotation of the rotor relative to the stator. While this arrangement may be effective, the radial size of the camshaft phaser is increased due to the need to increase the radial size of the rotor in order to accommodate features of the bias spring and the pin within the rotor.

What is needed is camshaft phaser which minimizes or eliminates one or more the shortcomings as set forth above.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and connectable to the crankshaft of the internal combustion engine to provide a fixed ratio of rotation between the stator and the crankshaft. The camshaft phaser also includes a rotor coaxially disposed within the stator, the rotor having a plurality of vanes extending radially outward from a central hub and interspersed with the stator lobes defining alternating advance chambers and retard chambers. The advance chambers receive pressurized oil in order to change the phase relationship between the crankshaft and the camshaft in an advance direction and the retard chambers receive pressurized oil in order to change the phase relationship between the camshaft and the crankshaft in a retard direction. The rotor is rotatable within the stator from a full retard position to a full advance position and is attachable to the camshaft of the internal combustion engine to prevent relative rotation between the rotor and the camshaft. A first portion of the central hub between adjacent ones of the plurality of vanes extends radially outward further than a second portion of the central hub between adjacent ones of the plurality of vanes, allowing for the camshaft phaser to be more radially compact while maintaining the required hydraulic area.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
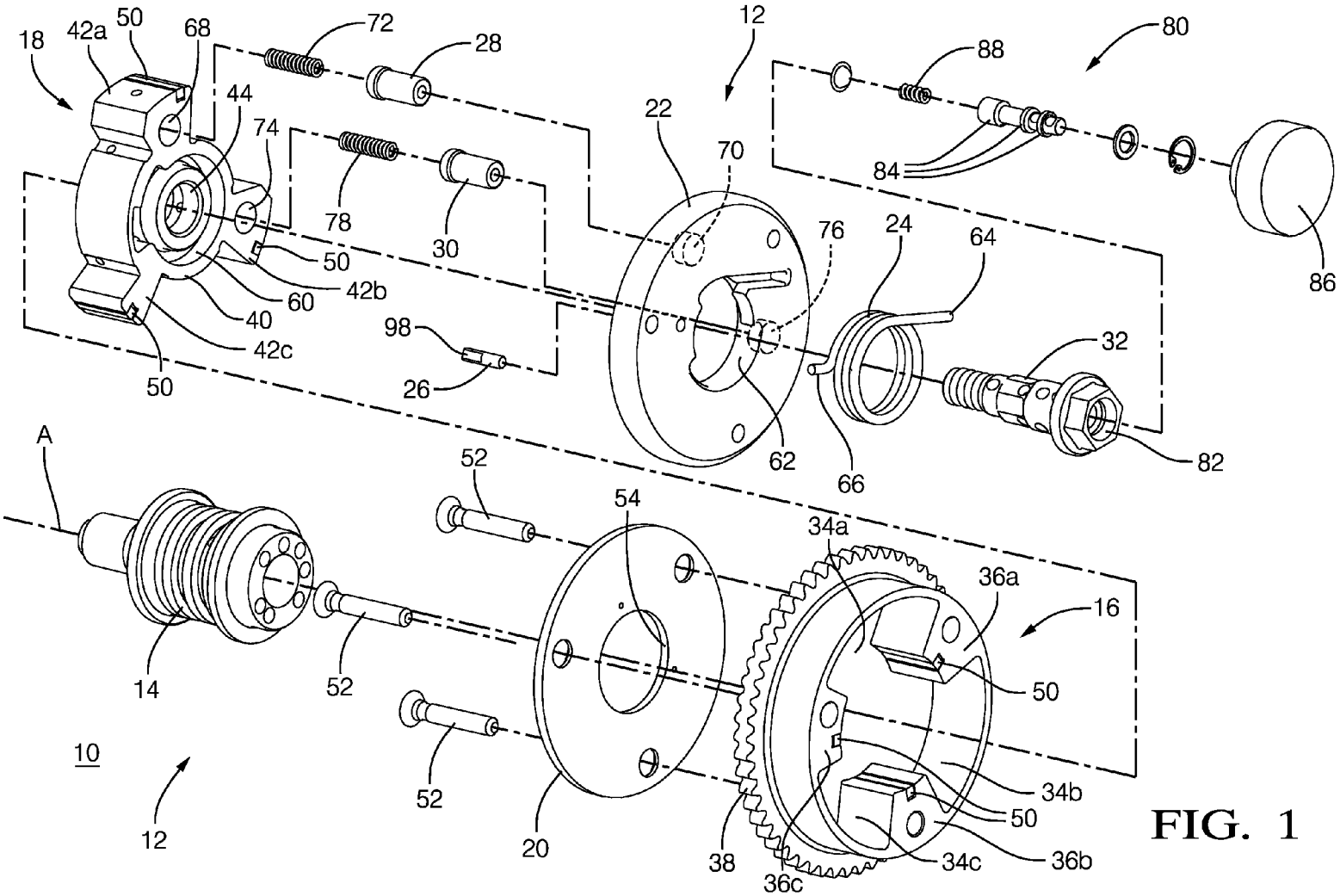
FIG. 1 is an exploded isometric view of a camshaft phaser in accordance with the present invention.
Figure 2:
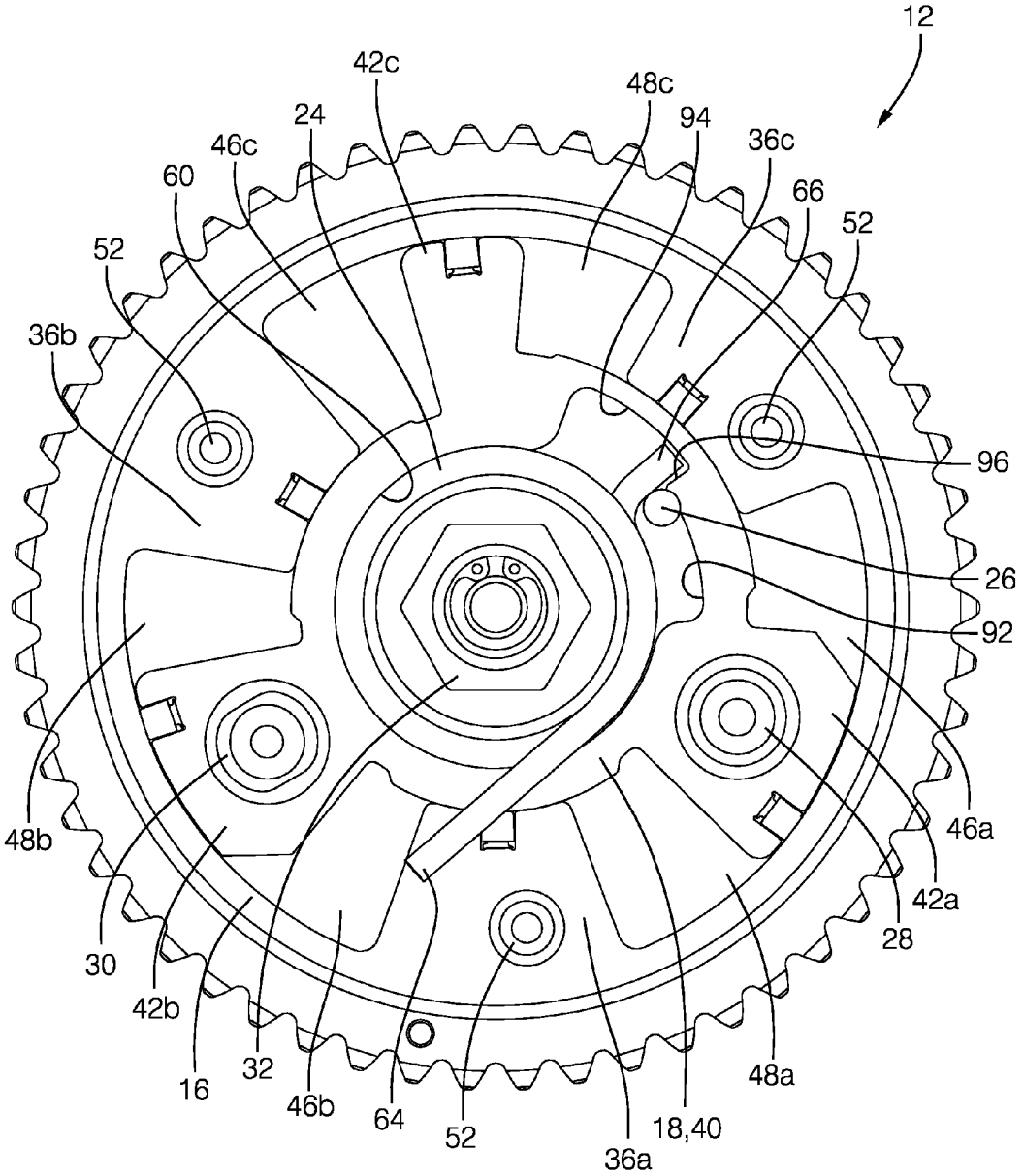
FIG. 2 is a front view of the camshaft phaser in accordance with the present invention with a front cover of the camshaft phaser removed.
Figure 3:
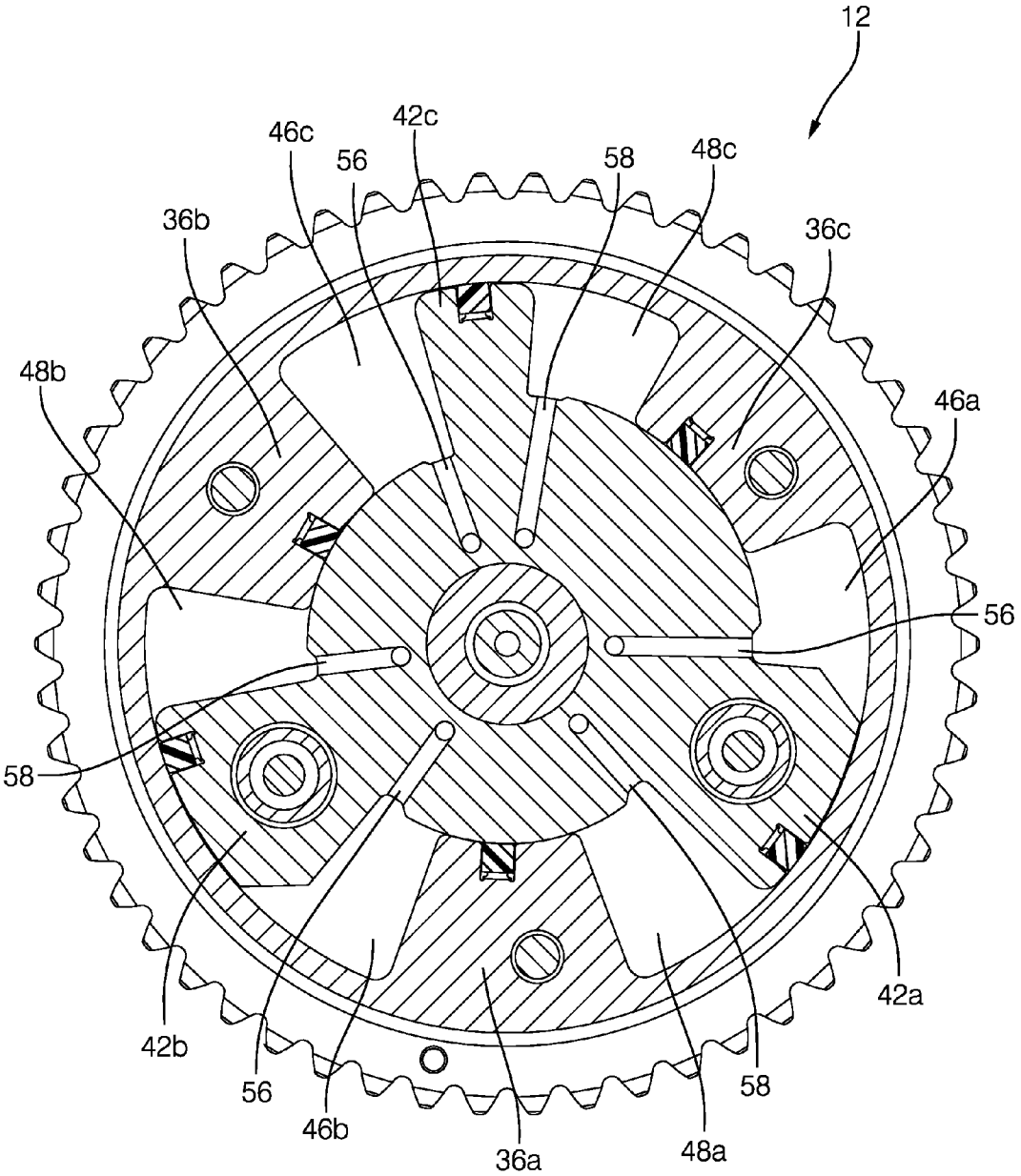
FIG. 3. is a radial cross-sectional view of the camshaft phaser in accordance with the present invention.

In accordance with a preferred embodiment of this invention and referring to FIGS. 1, 2, and 3, an internal combustion engine 10 is shown which includes a camshaft phaser 12. Internal combustion engine 10 also includes a camshaft 14 which is rotatable about an axis A based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 16, a rotor 18 disposed coaxially within stator 16, a back cover 20 closing off one end of stator 16, a front cover 22 closing off the other end of stator 16, a bias spring 24 for urging rotor 18 in one direction relative to stator 16, a bias spring stop pin 26 for neutralizing bias spring 24 for a portion of the range of travel of rotor 18 within stator 16, a primary lock pin 28, a secondary lock pin 30, and a camshaft phaser attachment bolt 32 for attaching camshaft phaser 12 to camshaft 14. The various elements of camshaft phaser 12 will be described in greater detail in the paragraphs that follow.

Stator 16 is generally cylindrical and includes a plurality of radial chambers 34*a*, 34*b*, 34*c* defined by a plurality of lobes 36*a*, 36*b*, 36*c* extending radially inward. From this point forward, each lobe 36*a*, 36*b*, 36*c* will be referred to generically as lobe 36 unless reference is being made to a specific lobe 36. Lobes 36*a*, 36*b* may extend radially inward substantially the same distance, however, lobe 36*c* extends radially inward a distance that is less that lobes 36*a*, 36*b*, as most easily seen in FIGS. 2 and 3, for reasons that will be more readily apparent when rotor 18 is described later. In the embodiment shown, there are three lobes 36 defining three radial chambers 34, however, it is to be understood that a different number of lobes 36 may be provided to define radial chambers 34 equal in quantity to the number of lobes 36. Stator 16 may also include a sprocket 38 formed integrally therewith or otherwise fixed thereto. Sprocket 38 is configured to be driven by a chain or gear that is driven by the crankshaft of internal combustion engine 10. Alternatively, sprocket 38 may be a pulley driven by a belt.

Rotor 18 includes a central hub 40 with a plurality of vanes 42*a*, 42*b*, 42*c* extending radially outward therefrom and a central through bore 44 extending axially therethrough. From this point forward, each vane 42*a*, 42*b*, 42*c* will be referred to generically as vane 42 unless reference is being made to a specific vane 42. The number of vanes 42 is equal to the number of radial chambers 34 provided in stator 16. Rotor 18 is coaxially disposed within stator 16 such that each vane 42 divides each radial chamber 34 into advance chambers 46*a*, 46*b*, 46*c* and retard chambers 48*a*, 48*b*, 48*c*. From this point forward, each advance chamber 46*a*, 46*b*, 46*c* will be referred to generically as advance chamber 46 unless reference is being made to a specific advance chamber 46. Similarly, each retard chamber 48*a*, 48*b*, 48*c* will be referred to generically as retard chamber 48 unless reference is being made to a specific retard chamber 48. The radial tips of lobes 36 are mateable with central hub 40 in order to separate radial chambers 34 from each other. Consequently, the portion of central hub 40 defined between vanes 42*a* and vane 42*c* extends radially outward further than the portions of central hub 40 defined between vane 42*a* and vane 42*b* and between vane 42*b* and vane 42*c*. Also consequently, advance chamber 46*a* and retard chamber 48*c* are smaller in the radial direction than advance chamber 46*b*, advance chamber 46*c*, retard chamber 48*a*, and retard chamber 48*b*. Each of the radial tips of lobes 36 and vanes 42 may include one of a plurality of wiper seals 50 to substantially seal adjacent advance chambers 46 and retard chambers 48 from each other.

Back cover 20 is sealingly secured, using cover bolts 52, to the axial end of stator 16 that is proximal to camshaft 14. Tightening of cover bolts 52 prevents relative rotation between back cover 20 and stator 16. Back cover 20 includes a back cover central bore 54 extending coaxially therethrough. The end of camshaft 14 is received coaxially within back cover central bore 54 such that camshaft 14 is allowed to rotate relative to back cover 20. In an alternative arrangement, sprocket 38 may be integrally formed or otherwise attached to back cover 20 rather than stator 16.

Similarly, front cover 22 is sealingly secured, using cover bolts 52, to the axial end of stator 16 that is opposite back cover 20. Cover bolts 52 pass through stator 16 and threadably engage front cover 22, thereby clamping stator 16 between back cover 20 and front cover 22 to prevent relative rotation between stator 16, back cover 20, and front cover 22. In this way, advance chambers 46 and retard chambers 48 are defined axially between back cover 20 and front cover 22.

Camshaft phaser 12 is attached to camshaft 14 with camshaft phaser attachment bolt 32 which extends coaxially through central through bore 44 of rotor 18 and threadably engages camshaft 14, thereby by clamping rotor 18 securely to camshaft 14. In this way, relative rotation between stator 16 and rotor 18 results in a change in phase or timing between the crankshaft of internal combustion engine 10 and camshaft 14.

Oil is selectively supplied to advance chambers 46 and vented from retard chambers 48 in order to cause relative rotation between stator 16 and rotor 18 which results in advancing the timing of camshaft 14 relative to the crankshaft of internal combustion engine 10. Conversely, oil is selectively supplied to retard chambers 48 and vented from advance chambers 46 in order to cause relative rotation between stator 16 and rotor 18 which results in retarding the timing of camshaft 14 relative to the crankshaft of internal combustion engine 10. Advance oil passages 56 may be provided in rotor 18 for supplying and venting oil from advance chambers 46 while retard oil passages 58 may be provided in rotor 18 for supplying and venting oil from retard chamber 48. Supplying and venting of oil to and from advance chambers 46 and retard chambers 48 may be controlled by a multi-way oil control valve that may be located either within camshaft phaser 12 as is known in the art, for example as shown in United States Patent Application Publication No. US 2012/0255509 A1 to Lichti et al. which is incorporated herein by reference in its entirety. Alternatively, the multi-way oil control valve may be located external to camshaft phaser 12 as is known in the art, for example as shown in United States Patent Application Publication No. US 2010/0288215 A1 to Takemura et al. which is incorporated herein by reference in its entirety. In this way, rotor 18 rotates within stator 16 between a maximum advance position and a maximum retard position as determined by the space available for vanes 42 to move within radial chambers 34.

Bias spring 24 is disposed within an annular pocket 60 formed in rotor 18 and within a central bore 62 of front cover 22. Bias spring 24 is grounded at a bias spring front cover end 64 thereof to front cover 22 while a bias spring rotor end 66 thereof engages rotor 18 for a portion of travel of rotor 18 within stator 16 as will be described in greater detail later. In this way, bias spring 24 either partially or completely offsets the natural retarding torque induced by the overall valve train friction, balances performance times, or helps return the phaser to a predetermined aligned position of rotor 18 within stator 16 which is between the full advance and full retard positions. When internal combustion engine 10 is shut down or if there is a malfunction of the multi-way valve that controls oil being supplied and vented to/from advance chambers 46 and retard chambers 48, bias spring 24 urges rotor 18 to a predetermined aligned position within stator 16 in a way that will be described in more detail in the subsequent paragraphs. Additional details of bias spring 24 and annular pocket 60 will also be provided later.

Primary lock pin 28 and secondary lock pin 30 define a staged dual lock pin system for selectively preventing relative rotation between stator 16 and rotor 18 at the predetermined aligned position which is between the full retard and full advance positions. Primary lock pin 28 is slidably disposed within a primary lock pin bore 68 formed in vane 42*a* of rotor 18. A primary lock pin seat 70 is formed in front cover 22 for selectively receiving primary lock pin 28 therewithin. Primary lock pin seat 70 is larger than primary lock pin 28 to allow rotor 18 to rotate relative to stator 16 about 5° on each side of the predetermined aligned position when primary lock pin 28 is seated within primary lock pin seat 70. The enlarged nature of primary lock pin seat 70 allows primary lock pin 28 to be easily received therewithin. When primary lock pin 28 is not desired to be seated within primary lock pin seat 70, pressurized oil is supplied to primary lock pin 28, thereby urging primary lock pin 28 out of primary lock pin seat 70 and compressing a primary lock pin spring 72. Conversely, when primary lock pin 28 is desired to be seated within primary lock pin seat 70, the pressurized oil is vented from primary lock pin 28, thereby allowing primary lock pin spring 72 to urge primary lock pin 28 toward front cover 22. In this way, primary lock pin 28 is seated within primary lock pin seat 70 by primary lock pin spring 72 when rotor 18 is positioned within stator 16 to allow alignment of primary lock pin 28 with primary lock pin seat 70.

Secondary lock pin 30 is slidably disposed within a secondary lock pin bore 74 formed in vane 42*b* of rotor 18. A secondary lock pin seat 76 is formed in front cover 22 for selectively receiving secondary lock pin 30 therewithin. Secondary lock pin 30 fits within secondary lock pin seat 76 in a close sliding relationship, thereby substantially preventing relative rotation between rotor 18 and stator 16 when secondary lock pin 30 is received within secondary lock pin seat 76. When secondary lock pin 30 is not desired to be seated within secondary lock pin seat 76, pressurized oil is supplied to secondary lock pin 30, thereby urging secondary lock pin 30 out of secondary lock pin seat 76 and compressing a secondary lock pin spring 78. Conversely, when secondary lock pin 30 is desired to be seated within secondary lock pin seat 76, the pressurized oil is vented from secondary lock pin 30, thereby allowing secondary lock pin spring 78 to urge secondary lock pin 30 toward front cover 22. In this way, secondary lock pin 30 is seated within secondary lock pin seat 76 by secondary lock pin spring 78 when rotor 18 is positioned within stator 16 to allow alignment of secondary lock pin 30 with secondary lock pin seat 76.

Further features and details of operation of primary lock pin 28 and secondary lock pin 30 are describe in U.S. Pat. No. 8,056,519 to Cuatt et al. which is incorporated herein by reference in its entirety.

A lock pin control valve spool 80 may control the supply and venting of pressurized oil to and from primary lock pin 28 and secondary lock pin 30. Lock pin control valve spool 80 may be slidably disposed within a valve bore 82 of camshaft phaser attachment bolt 32. Valve bore 82 is centered about axis A. Lock pin control valve spool 80 includes lands 84 and is axially displaced within valve bore 82 by an actuator 86 and a valve spring 88. Actuator 86 may be a solenoid actuator and may urge lock pin control valve spool 80 to a lock pin disengaged position by applying an electric current to actuator 86. Application of an electric current to actuator 86 causes lock pin control valve spool 80 to move toward the bottom of valve bore 82, thereby compressing valve spring 88 and positioning lands 84 to prevent oil from being vented from to primary lock pin 28 and secondary lock pin 30 while allowing pressurized oil to be supplied to primary lock pin 28 and secondary lock pin 30 from valve bore 82 which is supplied by internal combustion engine 10, for example, by a passage (not shown) in camshaft 14. Conversely, valve spring 88 may urge lock pin control valve spool 80 to a lock pin engaged position when no electric current is applied to actuator 86. When no electric current is applied to actuator 86, lock pin control valve spool 80 is moved away from the bottom of valve bore 82 by valve spring 88, thereby positioning lands 84 to prevent pressurized oil from being supplied to primary lock pin 28 and secondary lock pin 30 and to vent oil from primary lock pin 28 and secondary lock pin 30. While lock pin control valve spool 80 has been described as being located within camshaft phaser 12, it should be understood that a valve external to camshaft phaser 12 may alternatively be used as is known in the art, for example as shown in United States Patent Application Publication No. US 2012/0255509 A1 to Lichti et al. which is incorporated herein by reference in its entirety.

When it is desired to prevent relative rotation between rotor 18 and stator 16 at the predetermined aligned position, the pressurized oil is vented from both primary lock pin 28 and secondary lock pin 30, thereby allowing primary lock pin spring 72 and secondary lock pin spring 78 to urge primary lock pin 28 and secondary lock pin 30 respectively toward front cover 22. In order to align primary lock pin 28 and secondary lock pin 30 with primary lock pin seat 70 and secondary lock pin seat 76 respectively, rotor 18 may be rotated with respect to stator 16 by one or more of supplying pressurized oil to advance chambers 46, supplying pressurized oil to retard chambers 48, urging from bias spring 24, and torque from camshaft 14. Since primary lock pin seat 70 is enlarged, primary lock pin 28 will be seated within primary lock pin seat 70 before secondary lock pin 30 is seated within secondary lock pin seat 76. With primary lock pin 28 seated within primary lock pin seat 70, rotor 18 is allowed to rotate with respect to stator 16 by about 10°. Rotor 18 may be further rotated with respect to stator 16 by one or more of supplying pressurized oil to advance chambers 46, supplying pressurized oil to retard chambers 48, urging from bias spring 24, and torque from camshaft 14 in order to align secondary lock pin 30 with secondary lock pin seat 76, thereby allowing secondary lock pin 30 to be seated within secondary lock pin seat 76.

Bias spring 24 applies a torque to rotor 18 in the advance direction, i.e. clockwise as viewed in FIGS. 2 and 3, only from the full retard position to the predetermined aligned position. Furthermore, bias spring 24 does not apply a torque on rotor 18 on the advance side of the predetermined aligned position. This is accomplished by bias spring rotor end 66 of bias spring 24 extending radially outward from bias spring 24 and by bias spring stop pin 26 which is fixed to front cover 22 and consequently bias spring stop pin 26 is held stationary relative to stator 16. Bias spring stop pin 26 extends axially from front cover 22 in a direction toward back cover 20 where a stop pin accommodation notch 92 is formed in rotor 18 extending radially outward from annular pocket 60 in the portion of central hub 40 that is defined between vane 42*a* and vane 42*c*. Stop pin accommodation notch 92 allows rotor 18 to rotate freely relative to stator 16 without interference from bias spring stop pin 26. A bias spring rotor end accommodation notch 94 is also formed in rotor 18 radially outward from annular pocket 60 in the portion of central hub 40 that is defined between vane 42*a* and vane 42*c*. Bias spring rotor end accommodation notch 94 extends radially outward from annular pocket 60 further than stop pin accommodation notch 92, thereby allowing bias spring rotor end 66 to extend radially thereinto. Bias spring rotor end accommodation notch 94 is adjacent to stop pin accommodation notch 92 in the retard direction of rotor 18 travel, i.e. bias spring rotor end accommodation notch 94 is located counterclockwise to stop pin accommodation notch 92 as viewed in FIG. 2, thereby forming a bias spring reaction surface 96 between bias spring rotor end accommodation notch 94 and stop pin accommodation notch 92.

In operation, when rotor 18 is positioned within stator 16 at the predetermined aligned position as shown in FIG. 2, bias spring rotor end 66 of bias spring 24 engages bias spring stop pin 26 which is fixed to front cover 22. Consequently, bias spring stop pin 26 prevents bias spring 24 from applying a torque to rotor 18. As rotor 18 is rotated further in the advance direction of rotation relative to stator 16, i.e. clockwise as viewed in FIG. 2, bias spring stop pin 26 continues to prevent bias spring 24 from applying a torque to rotor 18 and bias spring rotor end accommodation notch 94 provides space for bias spring rotor end 66 of bias spring 24. Conversely, as rotor 18 is rotated in the retard direction of rotation relative to stator 16 from the predetermined aligned position, i.e. counterclockwise as viewed in FIG. 2, bias spring reaction surface 96 picks up bias spring rotor end 66 of bias spring 24 and winds up bias spring 24 as bias spring reaction surface 96 removes bias spring rotor end 66 of bias spring 24 from bias spring stop pin 26. Also as rotor 18 is rotated in the retard direction of rotation relative to stator 16 from the predetermined aligned position, stop pin accommodation notch 92 provides space for bias spring stop pin 26 which remains stationary. It should be noted that bias spring stop pin 26 as viewed in FIG. 2 shows the portion of bias spring stop pin 26 that is received by front cover 22 and that the portion of bias spring stop pin 26 that is received within stop pin accommodation notch 92 includes a flat 98 (shown in FIG. 1) which provides appropriate clearance with stop pin accommodation notch 92.

By making central hub 40 asymmetrical, i.e. the portion of central hub 40 defined between vanes 42*a* and vane 42*c* extending radially outward further than the portions of central hub 40 defined between vane 42*a* and vane 42*b* and between vane 42*b* and vane 42*c*, camshaft phaser 12 is allowed to be made more radially compact compared to a camshaft phaser with a symmetrical central hub and having the same hydraulic area, i.e. the effective area provided by the vanes and the lobes to react with pressurized oil. Being more radially compact reduces packaging size, overall mass, mass moment of inertia, and resistance to vibration.

While this invention has been described in terms of preferred embodiments thereof, it is not intended to be so limited.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft; and a rotor coaxially disposed within said stator, said rotor having a plurality of vanes extending radially outward from a central hub and interspersed with said plurality of lobes defining alternating advance chambers and retard chambers, wherein said advance chambers receive pressurized oil in order to change the phase relationship between said crankshaft and said camshaft in an advance direction and said retard chambers receive pressurized oil in order to change the phase relationship between said camshaft and said crankshaft in a retard direction, said rotor being rotatable within said stator from a full retard position to a full advance position and being attachable to said camshaft of said internal combustion engine to prevent relative rotation between said rotor and said camshaft;

wherein a first portion of said central hub between adjacent ones of said plurality of vanes extends radially outward further than a second portion of said central hub between adjacent ones of said plurality of vanes.

2. A camshaft phaser as in claim 1 wherein one of said plurality of lobes extends radially inward a distance that is less than the remaining said plurality of lobes extend radially inward.

3. A camshaft phaser as in claim 2 wherein said one of said plurality of lobes mates with said first portion of said central hub.

4. A camshaft phaser as in claim 1 further comprising:

a bias spring which applies torque to said rotor from said full retard position to a predetermined aligned position of said rotor which is between said full retard position and said full advance position, said bias spring having a first end which is grounded to said stator and a second end which engages said rotor from said full retard position to said predetermined aligned position; and a bias spring stop pin which is grounded to said stator and engages said bias spring from said predetermined aligned position to said full advance position, thereby preventing said bias spring from applying torque to said rotor between said predetermined aligned position and said full advance position.

5. A camshaft phaser as in claim 4 wherein:

said bias spring is disposed within an annular pocket formed in said rotor; and a bias spring second end accommodation notch extends radially outward from said annular pocket into said first portion of said central hub such that said second end of said bias spring is located within said bias spring second end accommodation notch.

6. A camshaft phaser as in claim 5 wherein a stop pin accommodation notch extends radially outward from said annular pocket into said first portion of said central hub such that said bias spring stop pin is located within said stop pin accommodation notch.

7. A camshaft phaser as in claim 6 wherein said bias spring second end accommodation notch extends radially outward from said annular pocket further than said stop pin accommodation notch.

8. A camshaft phaser as in claim 7 wherein said bias spring second end accommodation notch is adjacent to said stop pin accommodation notch such that a bias spring reaction surface is formed between said bias spring second end accommodation notch and said stop pin accommodation notch, said bias spring reaction surface engaging said second end of said bias spring only from said full retard position to said predetermined aligned position.

9. A camshaft phaser as in claim 4 further comprising:

a back cover closing off one axial end of said stator; and a front cover closing off the other axial end of said stator such that said advance chambers and said retard chambers are defined axially between said back cover and said front cover;

wherein said bias spring stop pin is fixed to said front cover.

10. A camshaft phaser as in claim 9 wherein said first end of said bias spring is grounded to said stator through said front cover.

11. A camshaft phaser as in claim 10 wherein a bias spring second end accommodation notch extends radially outward into said first portion of said central hub such that said second end of said bias spring is located within said bias spring second end accommodation notch.

12. A camshaft phaser as in claim 11 wherein a stop pin accommodation notch extends radially outward into said first portion of said central hub such that said bias spring stop pin is located within said stop pin accommodation notch.

13. A camshaft phaser as in claim 12 wherein said bias spring second end accommodation notch extends radially outward further than said stop pin accommodation notch.

14. A camshaft phaser as in claim 13 wherein said bias spring second end accommodation notch is adjacent to said stop pin accommodation notch such that a bias spring reaction surface is formed between said bias spring second end accommodation notch and said stop pin accommodation notch, said bias spring reaction surface engaging said second end of said bias spring only from said full retard position to said predetermined aligned position.

15. A camshaft phaser as in claim 4 wherein a bias spring second end accommodation notch extends radially outward into said first portion of said central hub such that said second end of said bias spring is located within said bias spring second end accommodation notch.

16. A camshaft phaser as in claim 15 wherein a stop pin accommodation notch extends radially outward into said first portion of said central hub such that said bias spring stop pin is located within said stop pin accommodation notch.

17. A camshaft phaser as in claim 16 wherein said bias spring second end accommodation notch extends radially outward further than said stop pin accommodation notch.

18. A camshaft phaser as in claim 17 wherein said bias spring second end accommodation notch is adjacent to said stop pin accommodation notch such that a bias spring reaction surface is formed between said bias spring second end accommodation notch and said stop pin accommodation notch, said bias spring reaction surface engaging said second end of said bias spring only from said full retard position to said predetermined aligned position.

* * * * *